US009214768B2

(12) United States Patent
Pao et al.

(10) Patent No.: US 9,214,768 B2
(45) Date of Patent: Dec. 15, 2015

(54) COMMUNICATION CONNECTOR AND TRANSMISSION MODULE THEREOF

(71) Applicant: TOPCONN ELECTRONIC (KUNSHAN) CO., LTD, Suzhou, Jiangsu Province (CN)

(72) Inventors: Chung-Nan Pao, New Taipei (TW); Wei Wang, Jiangsu Province (CN); Sun-Yu Chou, New Taipei (TW)

(73) Assignee: TOPCONN ELECTRONIC (KUNSHAN) CO., LTD., Suzhou, Jiangsu Province (CN)

( * ) Notice: Subject to any disclaimer, the term of this patent is extended or adjusted under 35 U.S.C. 154(b) by 44 days.

(21) Appl. No.: 14/108,447

(22) Filed: Dec. 17, 2013

(65) Prior Publication Data

US 2015/0171557 A1 Jun. 18, 2015

(51) Int. Cl.
*H01R 12/50* (2011.01)
*H01R 13/6587* (2011.01)

(52) U.S. Cl.
CPC ..... *H01R 13/6587* (2013.01)

(58) Field of Classification Search
CPC ..... H01R 23/688; H01R 23/025; H01R 23/7073; H01R 13/65802; H01R 13/514; H01R 13/648; H01R 13/28; H01R 12/724
USPC ..... 439/65, 79, 95, 108, 290, 701, 607.05, 439/607.07, 608, 660, 676
See application file for complete search history.

(56) References Cited

U.S. PATENT DOCUMENTS

| | | | | |
|---|---|---|---|---|
| 7,534,142 | B2 * | 5/2009 | Avery et al. | 439/607.05 |
| 7,914,303 | B2 * | 3/2011 | Amleshi et al. | 439/82 |
| 8,465,302 | B2 * | 6/2013 | Regnier et al. | 439/108 |
| 2013/0092429 | A1 * | 4/2013 | Ellison | 174/264 |

* cited by examiner

*Primary Examiner* — Amy Cohen Johnson
*Assistant Examiner* — Milagros Jeancharles
(74) *Attorney, Agent, or Firm* — Li & Cai Intellectual Property (USA) Office

(57) ABSTRACT

A transmission module of a communication connector includes a plurality of first signal terminals, a plurality of second signal terminals, and a plurality of ground terminals. The terminals are coupling along a coupling direction. Along the coupling direction, the grounding terminals respectively correspond to the first and second terminals, a main portion of each signal terminal is orthogonally projecting to an area of a main portion of the corresponding ground terminal, in which the area is located inside the contour of the main portion. Moreover, the width of the main portion is less than or equal to two times of the width of the main portion of the corresponding signal terminal. Thus, the instant disclosure provides the transmission module with novel type.

20 Claims, 11 Drawing Sheets

COMMUNICATION CONNECTOR AND TRANSMISSION MODULE THEREOF

BACKGROUND OF THE INVENTION

1. Field of the Invention

The instant disclosure relates to a connector; more particularly, to a communication connector and a transmission module thereof for transmitting high frequency signal.

2. Description of Related Art

The conventional communication connector includes a transmission module having several signal terminals and a grounding terminal, and the signal terminals and the grounding terminal are installed on a sheet-like insulating body. Specifically, a portion of the grounding terminal, which is disposed on the insulating body, has a substantially complete sheet construction (e.g., a rectangular sheet approximately conformed to the insulating body) for covering a portion of each signal terminal, which is embedded in the insulating body.

However, today's communication connector manufacturer has unconsciously limited to the structural framework of the conventional communication connector in the development process, thereby potentially affecting the progress of communication connector.

To achieve the abovementioned improvement, the inventors strive via industrial experience and academic research to present the instant disclosure, which can provide additional improvement as mentioned above.

SUMMARY OF THE INVENTION

One embodiment of the instant disclosure provides a communication connector and a transmission module thereof, each has a plurality of effects better than the conventional by a novelty structural design in reference to the conventional communication connector.

The communication connector of the instant disclosure comprises: a plurality of transmission modules stacked in one row along a coupling direction, and each transmission module comprising: a first signal wafer including a plurality of first signal terminals approximately in coplanar arrangement, each first signal terminal having a first main portion, a first mating portion, and a first tail, wherein the first mating portion and the first tail are respectively extended from two ends of the first main portion; a second signal wafer including a plurality of second signal terminals approximately in coplanar arrangement, each second signal terminal having a second main portion, a second mating portion, and a second tail, wherein the second mating portion and the second tail are respectively extended from two ends of the second main portion; and a grounding wafer including a plurality of grounding terminals approximately in coplanar arrangement, each grounding terminal having a main portion, a mating portion, and a tail, wherein the mating portion and the tail are respectively extended from two ends of the main portion; wherein at each transmission module along the coupling direction, the first signal terminals respectively correspond to the grounding terminals, the width of the main portion of each grounding terminal is less than or equal to two times of the width of the first main portion of the corresponding first signal terminal, and when each first main portion orthogonally projecting to the corresponding main portion, the contour of each first main portion is inside the contour of the corresponding main portion; the second signal terminals respectively correspond to the grounding terminals, the width of the main portion of each grounding terminal is less than or equal to two times of the width of the second main portion of the corresponding second signal terminal, and when each second main portion orthogonally projecting to the corresponding main portion, the contour of each second main portion is inside the contour of the corresponding main portion; and an outer casing sleeved at the transmission modules, the outer casing having at least one inserting opening, wherein the mating portions, the first mating portions, and the second mating portions are exposed from the inserting opening.

The transmission module of the communication connector of the instant disclosure comprises: a plurality of first signal terminals approximately in coplanar arrangement, each first signal terminal having a first main portion, a first mating portion, and a first tail, wherein the first mating portion and the first tail are respectively extended from two ends of the first main portion; a plurality of second signal terminals approximately in coplanar arrangement, each second signal terminal having a second main portion, a second mating portion, and a second tail, wherein the second mating portion and the second tail are respectively extended from two ends of the second main portion; and a plurality of grounding terminals approximately in coplanar arrangement, each grounding terminal having a main portion, a mating portion, and a tail, wherein the mating portion and the tail are respectively extended from two ends of the main portion; wherein the first signal terminals, the second signal terminals, and the grounding terminals are respectively arranged at three parallel planes, and the planes are perpendicular to a coupling direction, wherein at each transmission module along the coupling direction, the first signal terminals respectively correspond to the grounding terminals, the width of the main portion of each grounding terminal is less than or equal to two times of the width of the first main portion of the corresponding first signal terminal, and when each first main portion orthogonally projecting to the corresponding main portion, the contour of each first main portion is inside the contour of the corresponding main portion; the second signal terminals respectively correspond to the grounding terminals, the width of the main portion of each grounding terminal is less than or equal to two times of the width of the second main portion of the corresponding second signal terminal, and when each second main portion orthogonally projecting to the corresponding main portion, the contour of each second main portion is inside the contour of the corresponding main portion.

In summary, the communication connector of the instant disclosure, which has the effects better than the conventional, is provided with a novelty development by the cooperating design of the first, second, and grounding terminals.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

Please refer to FIGS. 1 through 4, which show an embodiment of the instant disclosure. The instant embodiment is a communication connector 100 used for providing an insertion of a mating connector or an electronic card (not shown) along an inserting direction S. The figures of the instant embodiment take a mini SAS HD connector for example, but the type of communication connector 100 is not limited thereto.

The communication connector 100 includes a plurality of transmission modules 10 and an outer casing 20. The transmission modules 10 are stacked in one row along a coupling direction C, which is approximately perpendicular to the inserting direction S. The outer casing 20 is sleeved at the stacked transmission modules 10 along the inserting direction S. The structure features of the transmission modules 10 are substantially identical, such that the following description just takes one of the transmission modules 10 for explaining.

Figure 5:
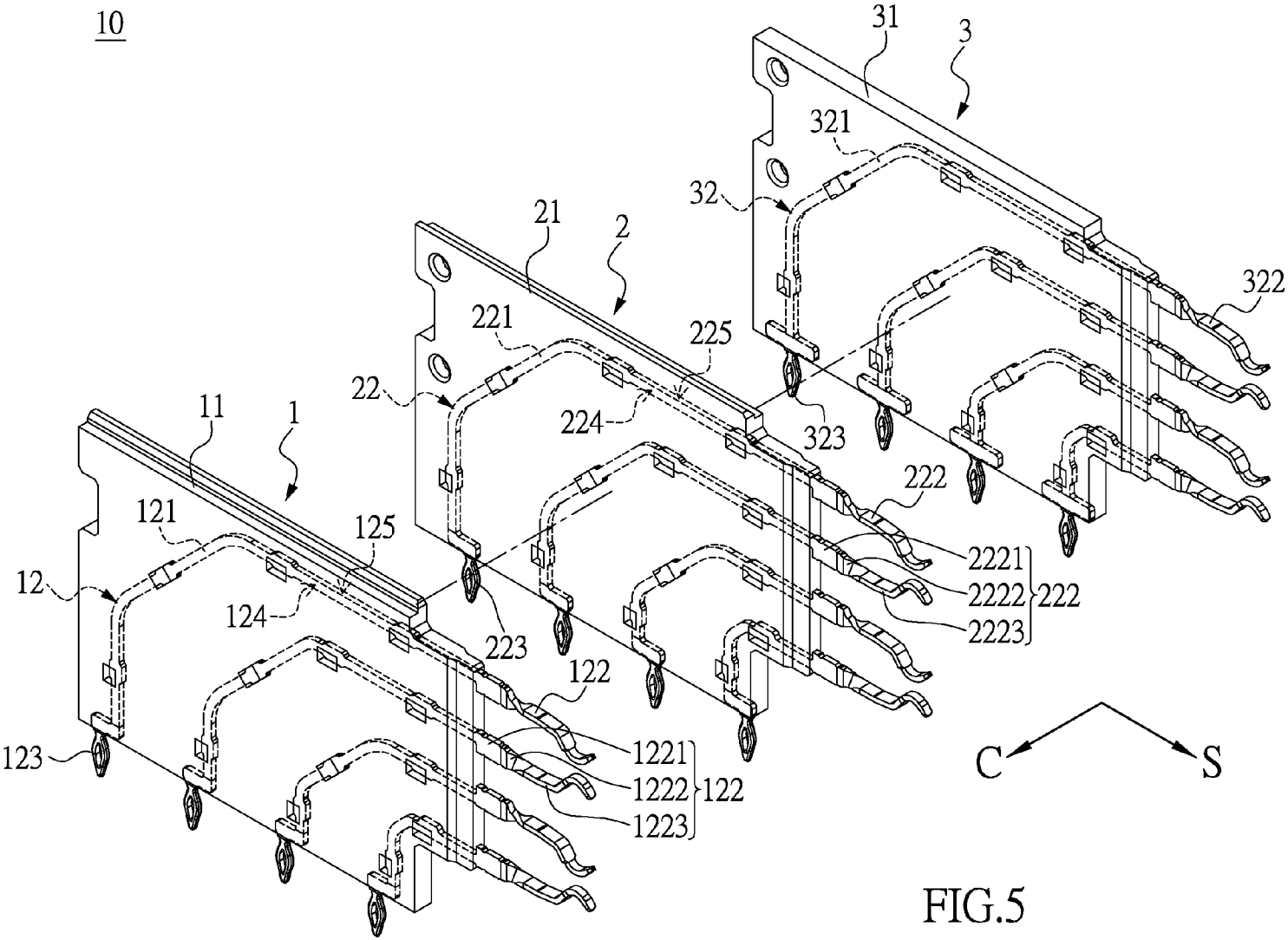
FIG. 5 is an exploded view of the transmission module of the communication connector according to the instant disclosure.
Figure 6:
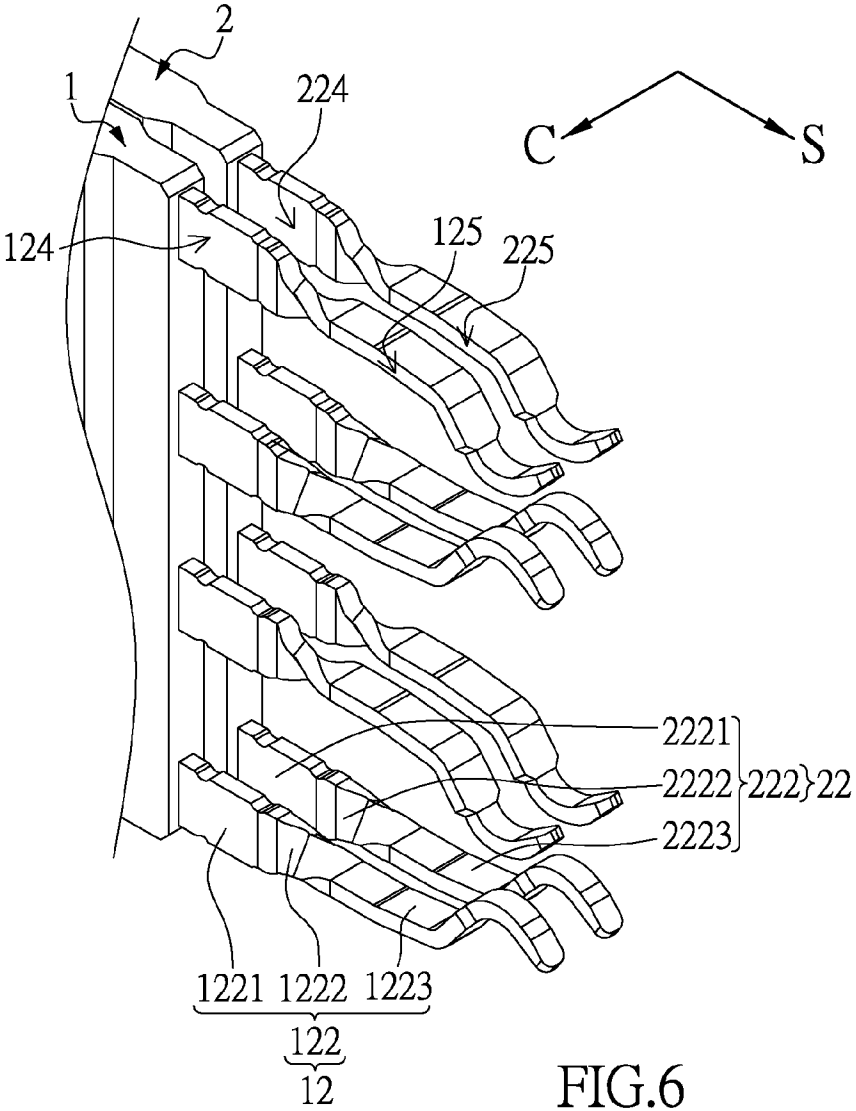
FIG. 6 is a partially enlarge view of the first and the adjacent second signal wafers of the transmission module according to the instant disclosure.

Please refer to FIGS. 5 and 6. The transmission module 10 includes a first signal wafer 1, a second signal wafer 2, and a grounding wafer 3. The first signal wafer 1, the second signal wafer 2, and the grounding wafer 3 are stacked in one row along the coupling direction C.

The first signal wafer 1 includes a sheet-like first insulating body 11 and four elongated first signal terminals 12. Each first signal terminal 12 has a first main portion 121, a first mating portion 122, and a first tail 123, in which the first mating portion 122 and the first tail 123 are integrally extended from two opposite ends of the first main portion 121. The outer surface of each first signal terminal 12 can be defined as two opposite side surfaces 124 and a surrounding surface 125 arranged between the side surfaces 124. The width of each side surface 124 is larger than the width of the surrounding surface 125, and each side surface 124 is perpendicular to the coupling direction C.

The first main portions 121 of the first signal terminals 12 are embedded in the first insulating body 11 for causing the first signal terminals 12 approximately in coplanar arrangement. Specifically, the side surfaces 124 of the first main portions 121 of the first signal terminals 12 are approximately arranged at the same plane. The outer surface of the first main portion 121 of each first signal terminal 12 is substantially embedded in the first insulating body 11, in which the said "substantially embedded" means part of the side surface 124 of the first main portion 121 exposed from the first insulating body 11 in order to provide a mold to position the first signal terminal 12 during the forming of the first insulating body 11. The outer surface of each first main portion 121, excluding the exposed side surface 124 of the first main portion 121, is embedded in the first insulating body 11. Moreover, the width of the exposed side surface 124 of the first main portion 121 is larger than the width of the embedded side surface 124 of the first main portion 121 (as shown in FIG. 5).

Additionally, the first mating portion 122 is extended from the first main portion 121 approximately along the inserting direction S, and the extension direction of the first mating portion 122 is substantially perpendicular to an extension direction of the first tail 123 extended from the first main portion 121. The first mating portion 122 of each first signal terminal 12 has a first extending segment 1221, a first twisted segment 1222, and a first coupling segment 1223, which are extended from the first main portion 121 sequentially. The side surface 124 of the first extending segment 1221 has a width, which is two times greater than the width of the side surface 124 of the first main portion 121 adjacent to the first extending segment 1221. The side surface 124 of the first coupling segment 1223 is non-parallel to the side surface 124 of the first extending segment 1221 because of the twist of the first twisted segment 1222.

Specifically, the first twisted segment 1222 in the instant embodiment is twisted from the first extending segment 1221 toward the first coupling segment 1223 with substantially ninety degrees. Any two adjacent first twisted segments 1222 of the first signal wafer 1 respectively have two opposite twist directions (e.g., if taking the inserting direction S to be a central axis, one twisted segment 1222 twists along a clockwise direction, and another adjacent twisted segment 1222 twists along a counter clockwise direction). In other words, the side surface 124 of the first extending segment 1221 adjacent to the first twisted segment 1222 is substantially perpendicular to the side surface 124 of the first coupling segment 1223 adjacent to the first twisted segment 1222.

Particularly, in order to avoid a swelling problem generated from the twist of the first twisted segment 1222, the width of the side surface 124 of the first twisted segment 1222 gradually reduce along a direction, which is defined from the first extending segment 1221 toward the first coupling segment 1223. That is to say, the width of the side surface 124 of the first extending segment 1221 adjacent to one end of the first twisted segment 1222 is larger than the width of the side surface 124 of the first coupling segment 1223 adjacent to another end of the first twisted segment 1222.

The second signal wafer 2 includes a sheet-like second insulating body 21 and four elongated second signal terminals 22. Each second signal terminal 22 has a second main portion 221, a second mating portion 222, and a second tail 223, in which the second mating portion 222 and the second tail 223 are integrally extended from two opposite ends of the second main portion 221. The outer surface of each second signal terminal 22 can be defined as two opposite side surfaces 224 and a surrounding surface 225 arranged between the side surfaces 224. The width of each side surface 224 is larger than the width of the surrounding surface 225, and each side surface 224 is perpendicular to the coupling direction C.

The second main portions 221 of the second signal terminals 22 are embedded in the second insulating body 21 for causing the second signal terminals 22 approximately in coplanar arrangement. Specifically, the side surfaces 224 of the second main portions 221 of the second signal terminals 22 are approximately arranged at the same plane. The outer surface of the second main portion 221 of each second signal terminal 22 is substantially embedded in the second insulating body 21, in which the said "substantially embedded" means part of the side surface 224 of the second main portion 221 exposed from the second insulating body 21 in order to provide a mold to position the second signal terminal 22 during the forming of the second insulating body 21. The outer surface of each second main portion 221, excluding the exposed side surface 224 of the second main portion 221, is embedded in the second insulating body 21. Moreover, the width of the exposed side surface 224 of the second main portion 221 is larger than the width of the embedded side surface 224 of the second main portion 221 (as shown in FIG. 5).

Additionally, the second mating portion 222 is extended from the second main portion 221 approximately along the inserting direction S, and the extension direction of the second mating portion 222 is substantially perpendicular to an extension direction of the second tail 223 extended from the second main portion 221. The second mating portion 222 of each second signal terminal 22 has a second extending segment 2221, a second twisted segment 2222, and a second coupling segment 2223, which are extended from the second main portion 221 sequentially. The side surface 224 of the second extending segment 2221 has a width, which is two times greater than the width of the side surface 224 of the second main portion 221 adjacent to the second extending segment 2221. The side surface 224 of the second coupling segment 2223 is non-parallel to the side surface 224 of the second extending segment 2221 because of the twist of the second twisted segment 2222.

Specifically, the second twisted segment 2222 in the instant embodiment is twisted from the second extending segment 2221 toward the second coupling segment 2223 with substantially ninety degrees. Any two adjacent second twisted segments 2222 of the second signal wafer 2 respectively have two opposite twist directions (e.g., if taking the inserting direction S to be a central axis, one twisted segment 2222 twists along a clockwise direction, and another adjacent twisted segment 2222 twists along a counter clockwise direction). In other words, the side surface 224 of the second extending segment 2221 adjacent to the second twisted segment 2222 is substantially perpendicular to the side surface 224 of the second coupling segment 2223 adjacent to the second twisted segment 2222.

Particularly, in order to avoid a swelling problem generated from the twist of the second twisted segment 2222, the width of the side surface 224 of the second twisted segment 2222 gradually reduce along a direction, which is defined from the second extending segment 2221 toward the second coupling segment 2223. That is to say, the width of the side surface 224 of the second extending segment 2221 adjacent to one end of the second twisted segment 2222 is larger than the width of the side surface 224 of the second coupling segment 2223 adjacent to another end of the second twisted segment 2222.

Please refer to FIG. 6. At two adjacent first and second signal wafers 1, 2 of the transmission module 10 along the coupling direction C, the first signal terminals 12 respectively correspond to the second signal terminals 22, each first signal terminal 12 and the corresponding and adjacent second signal terminal 22 are defined as a pair of differential signal terminals, when each first main portion 121 orthogonally projecting to the corresponding second main portion 221, the contour of each first main portion 121 aligns the contour of the corresponding second main portion 221, and the surrounding surface 125 of the first mating portion 122 of each signal terminal 12 is at least partially adjacent and facing to the surrounding surface 225 of the corresponding second mating portion 222.

Specifically, along the coupling direction C, a portion of the surrounding surface 125 of the first coupling segment 1223 of each signal terminal 12 is adjacent to a portion of the surrounding surface 225 of the corresponding second coupling segment 2223, and the adjacent portions of the surrounding surfaces 125, 225 are facing and parallel to each other. Thus, the first coupling segment 1223 of each first signal terminal 12 and the corresponding second coupling segment 2223 can be used for transmitting signal by narrow coupling.

Additionally, the instant embodiment takes each first coupling segment 1223 and the corresponding second coupling segment 2223 formed in the narrow coupling type as shown in the FIG. 6 for example, but in use, the number of the first coupling segment 1223 and the corresponding second coupling segment 2223 formed in the narrow coupling type can be changed according to the designer's demand.

Figure 7:
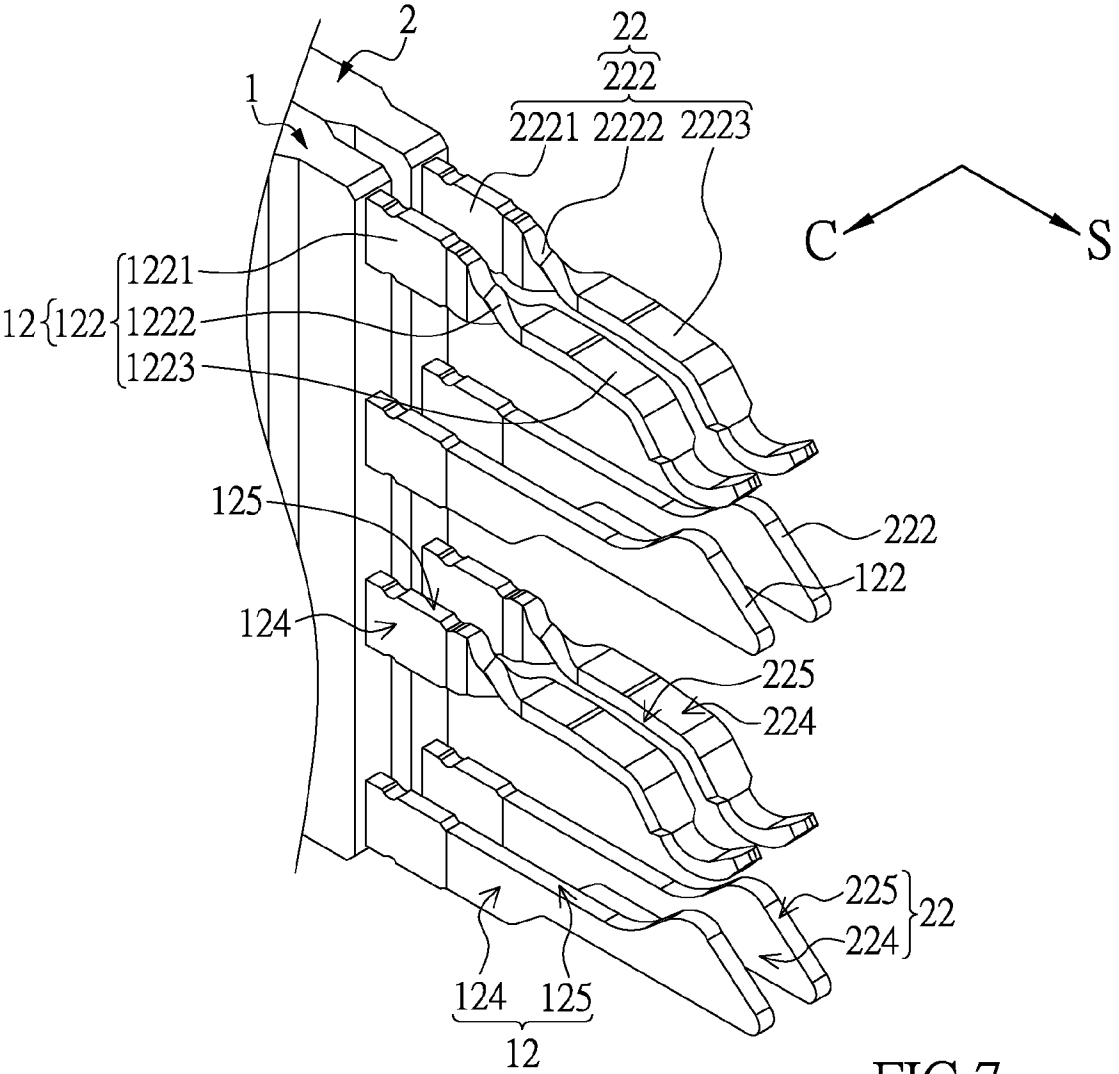
FIG. 7 is a partially enlarge view of the first and the adjacent second signal wafers of the transmission module in another type according to the instant disclosure.

Particularly, the surrounding surface 125 of at least one of the first mating portions 122 is at least partially adjacent and facing to the surrounding surface 225 of the corresponding second mating portion 222. For example, as shown in FIG. 7, the first signal wafer 1 only has two first signal terminals 12 (i.e., the first and third terminals counted from top to down of FIG. 7) provided with the first mating portions 122, which are respectively narrow coupling to the corresponding second mating portions 222. The other two first signal terminals 12 (i.e., the second and fourth terminals counted from top to down of FIG. 7) provided with the first mating portions 122, which are respectively broad coupling to the corresponding second mating portions 222.

The said "broad coupling" is approximately stated as follows. Along the coupling direction C, the side surface 124 of the first mating portion 122 is adjacent to the side surfaces 224 of the corresponding second mating portion 222, and the adjacent side surfaces 124, 224 are facing and parallel to each other. Thus, the adjacent side surfaces 124, 224 of the first and second mating portions 122, 222 can be used for transmitting signal by broad coupling.

Please refer to FIG. 5. The grounding wafer 3 includes a sheet-like insulating body 31 and four elongated grounding terminals 32. Each grounding terminal 32 has a main portion 321, a mating portion 322, and a tail 323, in which the mating portion 322 and the tail 323 are integrally extended from two opposite ends of the main portion 321. The main portions 321 of the grounding terminals 32 are embedded in the insulating body 31 to cause the grounding terminals 32 approximately in coplanar arrangement. The outer surface of the main portion 321 of each grounding terminal 32 is substantially embedded in the insulating body 31, in which the said "substantially embedded" means part of the side surface of the main portion 321 exposed from the insulating body 31 in order to provide a mold to position the grounding terminal 32 during the forming of the insulating body 31. The outer surface of each main portion 321, excluding the exposed side surface of the main portion 321, is embedded in the insulating body 31. Moreover, the width of the exposed side surface of the main portion 321 is larger than the width of the embedded side surface of the main portion 321 (as shown in FIG. 5).

The constructions of the grounding terminals 32 of the grounding wafer 3 as shown in FIG. 5 are similar to the constructions of the first signal terminals 12 of the first signal wafer 1 (or the constructions of the second signal terminals 22 of the second signal wafer 2), such that the instant embodiment does not disclose the detail structural features of the grounding wafer 3 again.

At the transmission module 10, the first signal terminals 12, the second signal terminals 22, and the grounding terminals 33 are respectively arranged at three parallel planes, which are perpendicular to the coupling direction C. At the transmission module 10 along the coupling direction C, the first signal terminals 12 respectively correspond to the grounding terminals 32, and the second signal terminals 22 respectively correspond to the grounding terminals 32. Particularly, when each first main portion 121 orthogonally projecting to the corresponding main portion 321, the contour of each first main portion 121 aligns the contour of the corresponding main portion 321 (as shown in FIG. 8), and when each second main portion 221 orthogonally projecting to the corresponding main portion 321, the contour of each second main portion 221 aligns the contour of the corresponding main portion 321.

Figure 2:
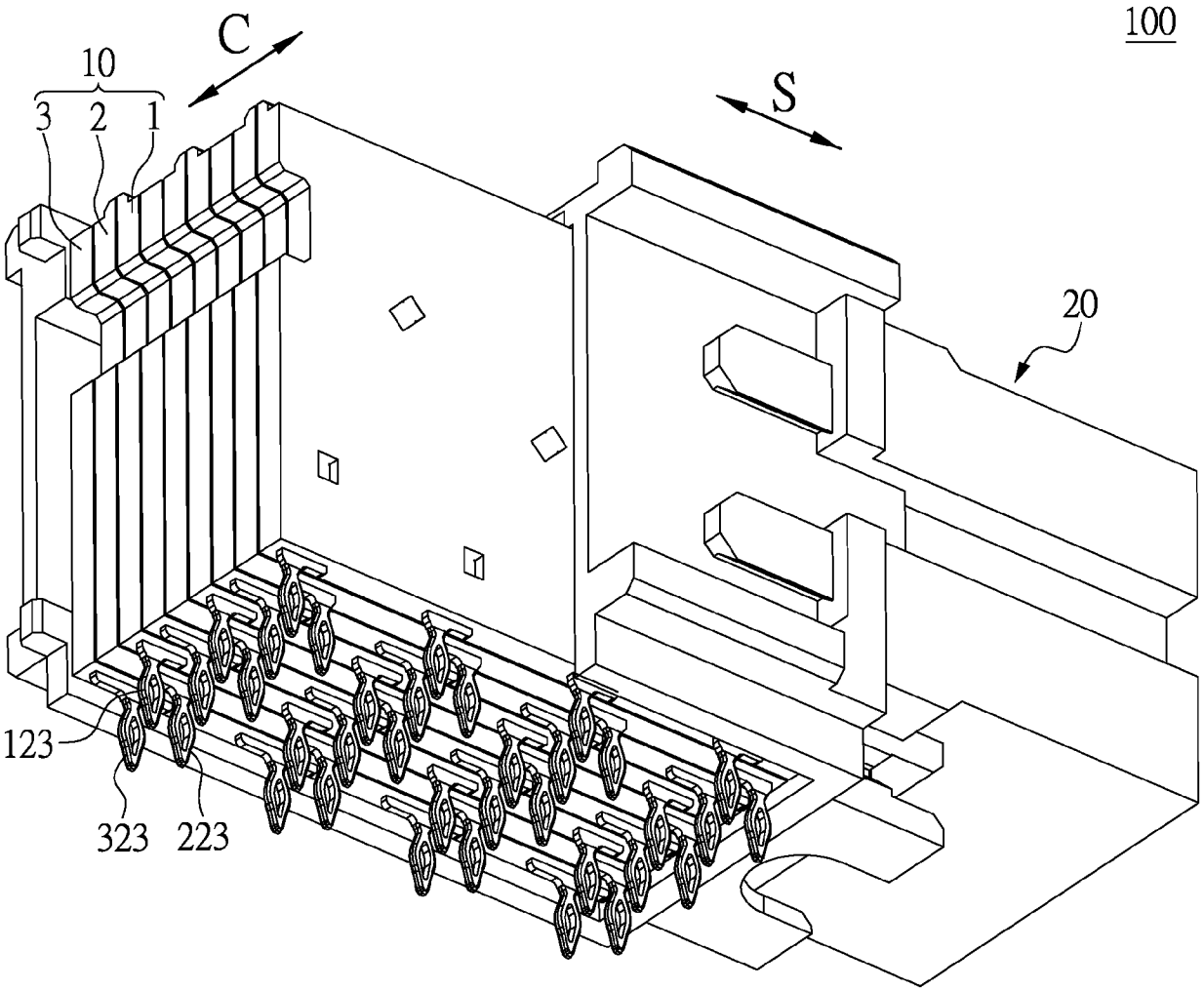
FIG. 2 is another perspective view of the communication connector according to the instant disclosure.
Figure 3:
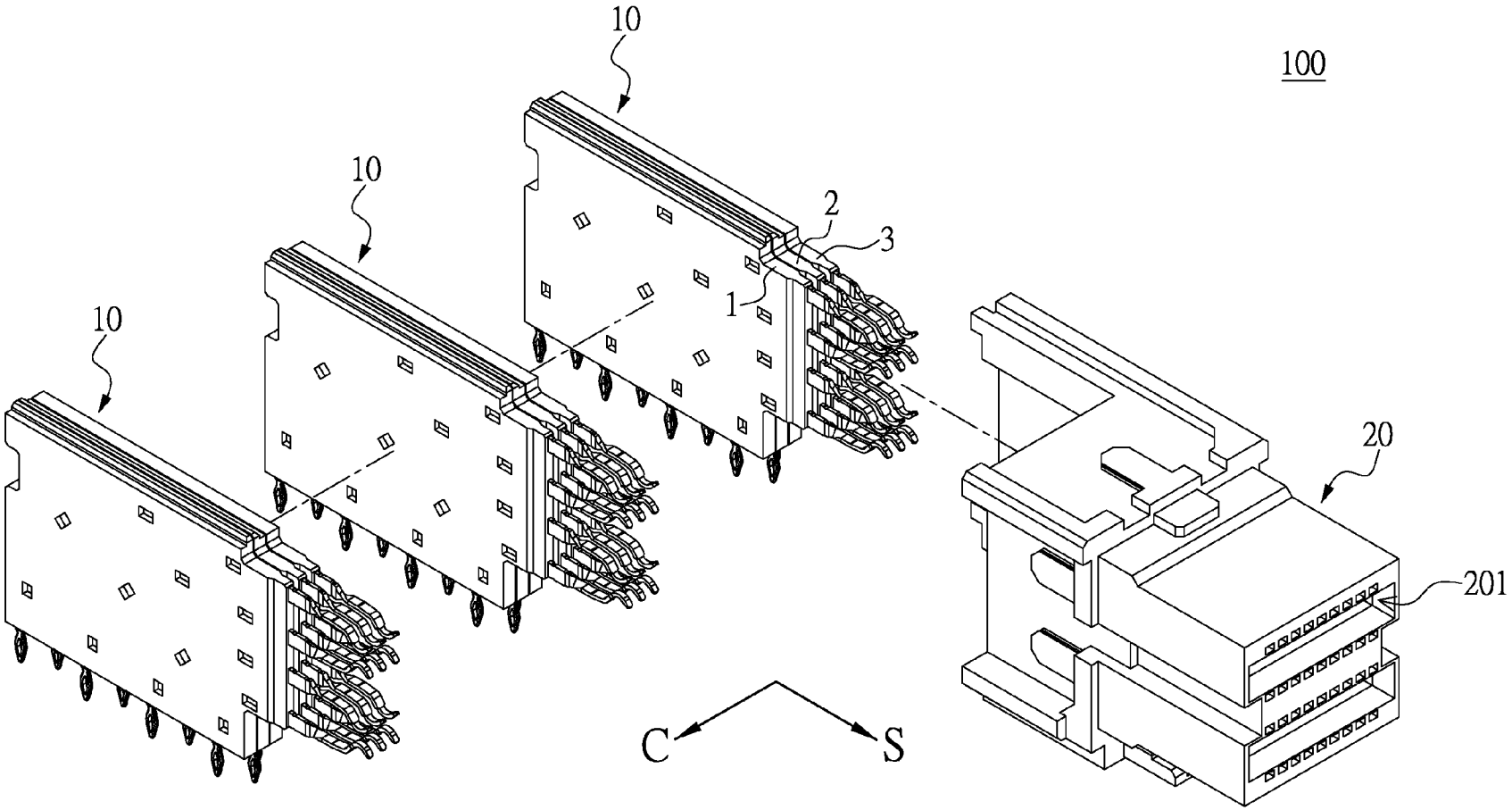
FIG. 3 is an exploded view of the communication connector according to the instant disclosure.
Figure 4:
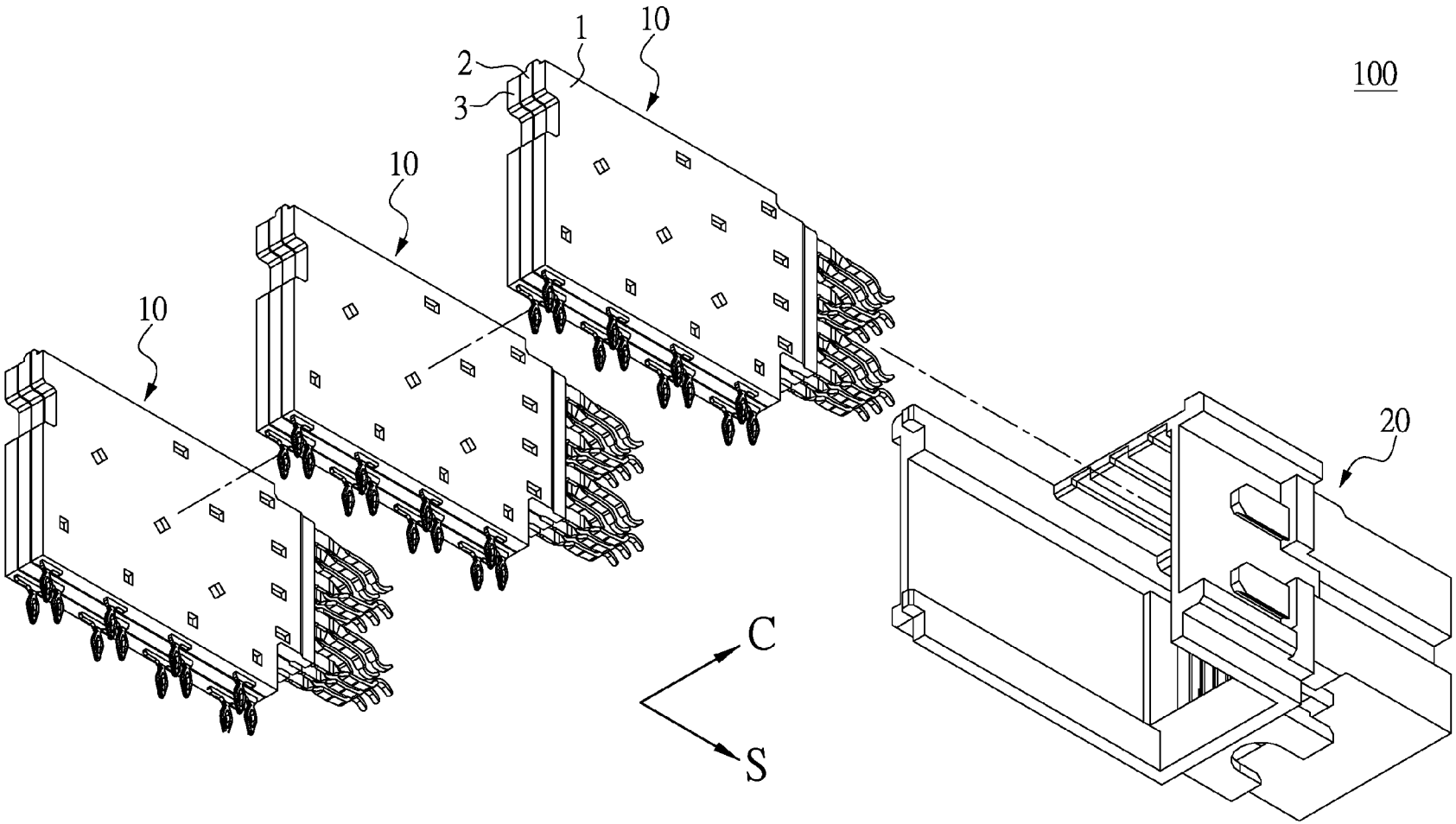
FIG. 4 is another exploded view of the communication connector according to the instant disclosure.
Figure 8:
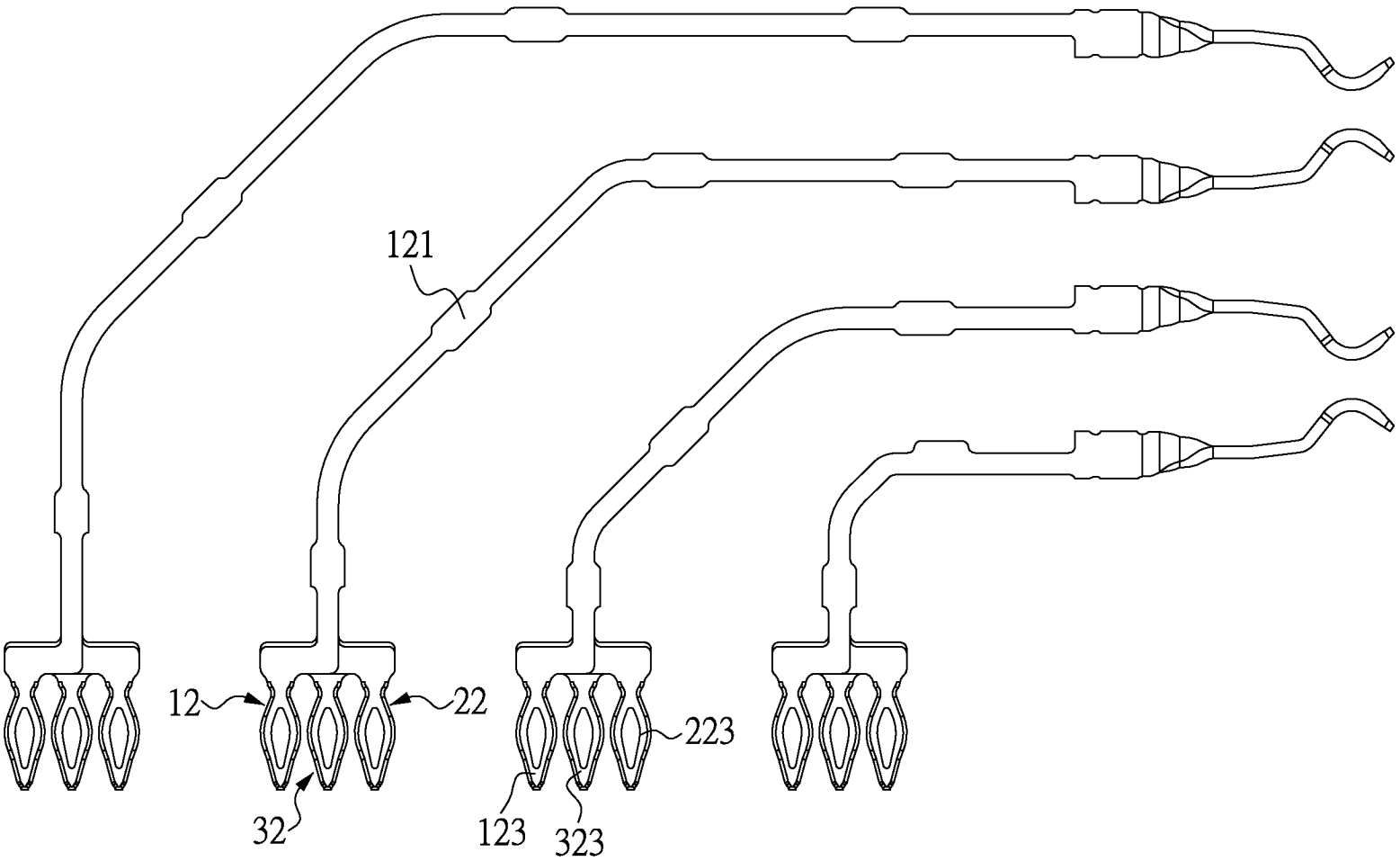
FIG. 8 is a perspective view of the terminals of the transmission module when viewing along a coupling direction according to the instant disclosure.

Moreover, at the transmission module 10 along the coupling direction C, the first tail 123, the corresponding second tail 223, and the corresponding tail 323 are in a staggered arrangement as shown in FIGS. 2 and 8, that is to say, the coupling direction C cannot pass through any two of the first tail 123, the corresponding second tail 223, and the corresponding tail 323 at the same time.

Besides, as shown in FIG. 5, the first main portion 121 and the first mating portion 122 of the first signal terminal 12, the second main portion 221 and the second mating portion 122 of the corresponding second signal terminal 22, and the main portion 321 and the mating portion 322 of the corresponding grounding terminal 32 are substantially identical. The width of the first main portion 121 (i.e., the width of the side surface 124 of the first main portion 121), the width of the second main portion 221 (i.e., the width of the side surface 224 of the second main portion 221), or the width of the main portion 321 (i.e., the width of the side surface of the main portion 321) is preferably larger than or equal to 0.24 mm. However, the width or proportion of the main portion 321 can be changed according to the designer's demand.

For example, the width of the main portion 321 of each grounding terminal 32 can be designed larger than the width of the corresponding first main portion 121, and larger than the width of the corresponding second main portion 221. Preferably, the width of the main portion 321 of each grounding terminal 32 is less than or equal to two times of the width of the corresponding first main portion 121, and when each first main portion 121 orthogonally projecting to the corresponding main portion 321, the contour of each first main portion 121 is inside the contour of the corresponding main portion 321. The width of the main portion 321 of each grounding terminal 32 is less than or equal to two times of the width of the corresponding second main portion 221, and when each second main portion 221 orthogonally projecting to the corresponding main portion 321, the contour of each second main portion 221 is inside the contour of the corresponding main portion 321. For example, as shown in FIG. 2, the width of the main portion 321 of each grounding terminal 32 is equal to two times of the width of the corresponding first main portion 121, and the width of the main portion 321 of each grounding terminal 32 is equal to two times of the width of the corresponding second main portion 221.

The above description discloses the features of one transmission module 10, and the feature of the stacked transmission modules 10 is approximately stated as follows. At the grounding wafers 3 of the transmission modules 10, the main portions 321 of the grounding terminals 32 are isolated and independent to each other in structural construction and electrical connection, that is to say, the communication connector 100 of the instant disclosure does not connect (e.g., series connect) the grounding terminals 32 of the stacked transmission modules 10 by an additional conductive component.

Figure 1:
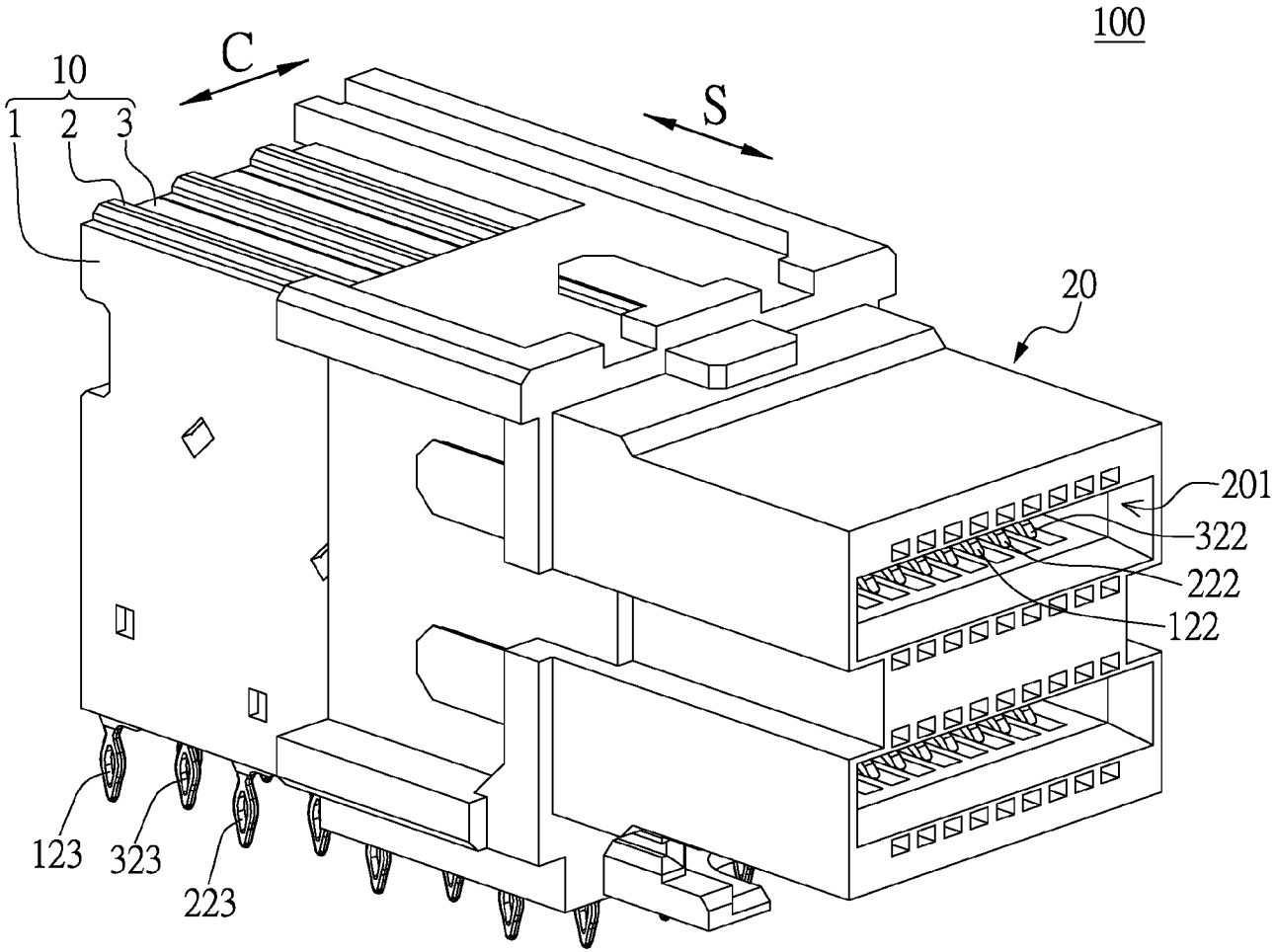
FIG. 1 is a perspective view of a communication connector according to the instant disclosure.

Please refer to FIG. 1. The outer casing 20 has two inserting openings 201, and the outer casing 20 is sleeved at the stacked transmission modules 10. The mating portions 322, the first mating portions 122, and the second mating portions 222 are exposed from the inserting openings 201 for contacting the mating connector or electronic card (not shown), which is inserted into the inserting openings 201.

Base on the above, when the communication connector 100 of the instant disclosure is used to transmit the high frequency signal, the communication connector 100 may have the effects as follows. When each first main portion 121 and each second main portion 221 orthogonally projecting to the corresponding main portion 321 along the coupling direction C, the contour of each first main portion 121 and the contour of each second main portion 221 are inside the contour of the corresponding main portion 321, thereby obtaining a high frequency effect (i.e., crosstalk) better than the conventional communication connector. When the first main portion 121, the corresponding second main portion 221, and the corresponding main portion 321 have the same constructions and the same contours, which align with each other along the coupling direction C, the communication connector 100 not only obtains the better high frequency effect, but also reduces the cost by producing the first signal, the second signal, and the grounding terminals 12, 22, 32 with one mold and different die molds, in which the different die molds are used for producing the different parts of the terminals (i.e., first tail, second tail, tail 123, 223, 323). Moreover, the communication connector 100 of the instant disclosure does not need any conductive component to connect (e.g., series connect) the grounding terminals 32 of the stacked transmission modules 10, so that the assembly steps and the structure of the communication connector 100 can be simplified.

Additionally, the first coupling segment 1223 and the adjacent second coupling segment 2223 of the communication connector 100 are formed in narrow coupling type, that is different from the broad coupling type of the conventional communication connector, thereby obtaining an impedance more stable than the conventional communication connector.

Figure 10:
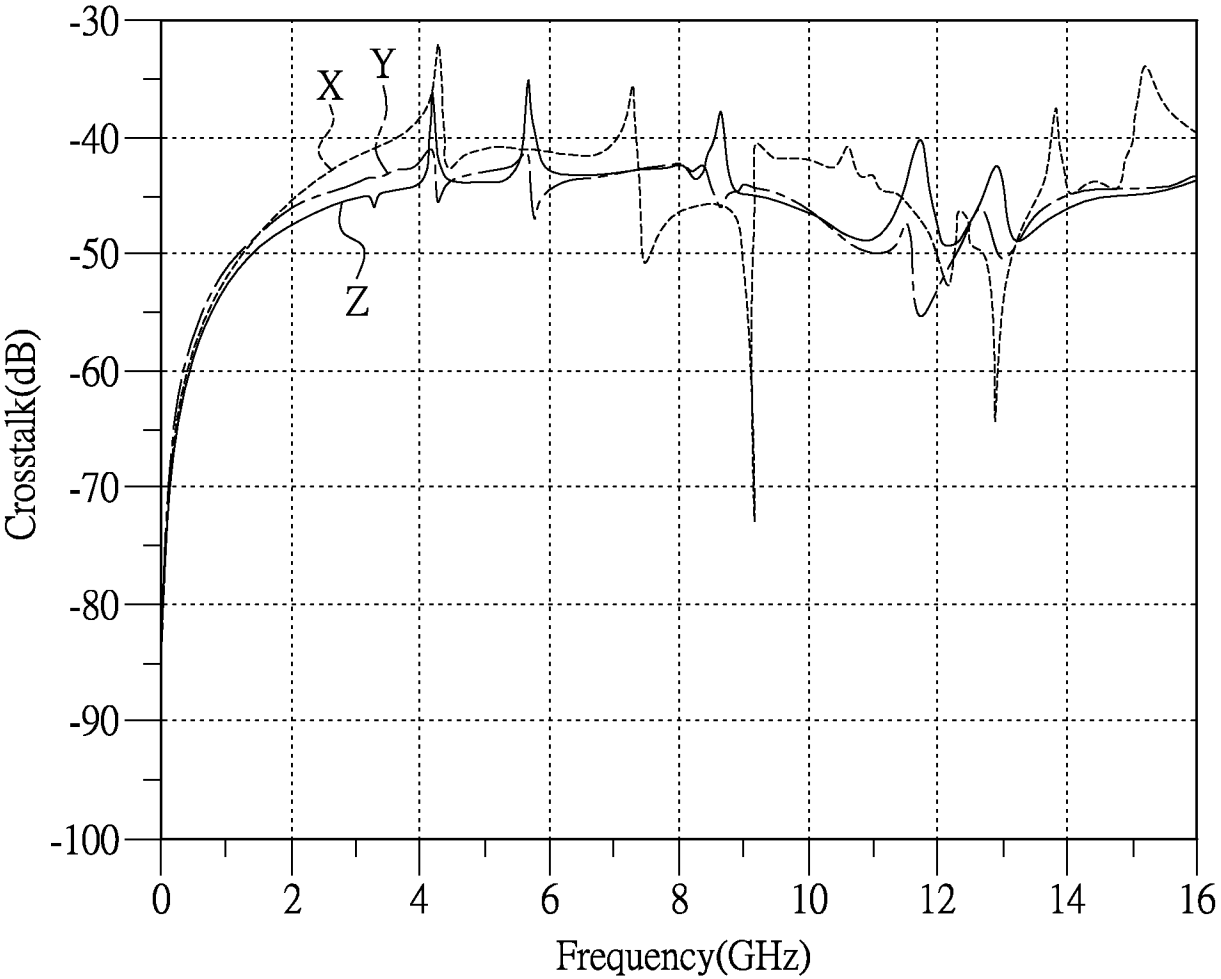
FIG. 10 is a simulation diagram of the crosstalk of the communication connector of the instant disclosure with respect to the conventional communication connector.
Figure 11:
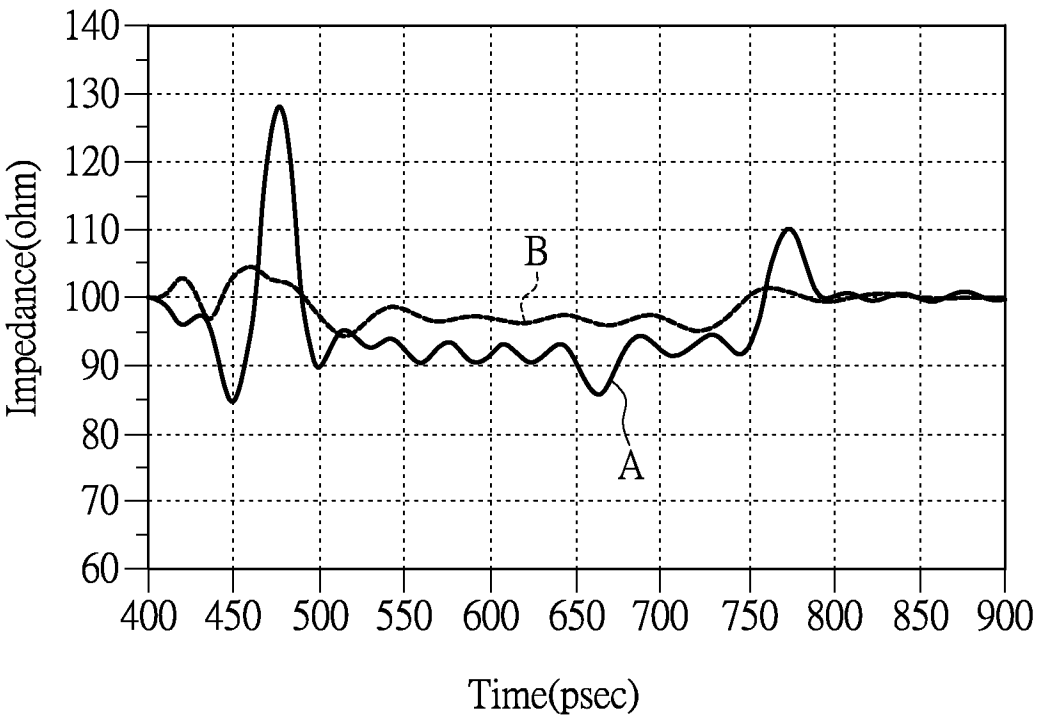
FIG. 11 is a simulation diagram of the impedance of the communication connector of the instant disclosure with respect to the conventional communication connector.

In order to objectively confirm the above effects of the instant disclosure, the inventor carries out the simulating test of the communication connector 100 with respect to the conventional communication connector as shown in FIGS. 10 and 11.

Please refer to FIG. 10, which shows a simulation diagram of the crosstalk of the communication connector 100 of the instant disclosure with respect to the conventional communication connector during the frequency from 0 to 16 GHz. The curve X in FIG. 10 presents the simulation curve of the crosstalk of the conventional communication connector, which has the grounding terminal with a substantially complete sheet construction; the curve Y in FIG. 10 presents a simulation curve the crosstalk of the communication connector 100 as shown in FIG. 5; the curve Z in FIG. 10 presents a simulation curve the crosstalk of the communication connector 100 as shown in FIG. 5, in which the terminals of FIG. 5 are replaced by the terminals of FIG. 9.

According to FIG. 10, the crosstalk value of the curve X is substantially lower than −32 dB, so that the maximum crosstalk value of the curve X is −32 dB at 4.2 GHz; the crosstalk value of the curve Y is substantially lower than −42 dB, so that the maximum crosstalk value of the curve Y is −42 dB at 4.2 GHz; and the crosstalk value of the curve Z is substantially lower than −35 dB, so that the maximum crosstalk value of the curve Z is −35 dB at 5.7 GHz. Specifically, the crosstalk value of the curve Y is lower than the crosstalk value of the curve Z, and the crosstalk value of the curve Z is lower than the crosstalk value of the curve X. That is to say, about the crosstalk-resistant, the curve Y is best, the curve Z is only worse than the curve Y, and the curve X is worst.

Figure 9:
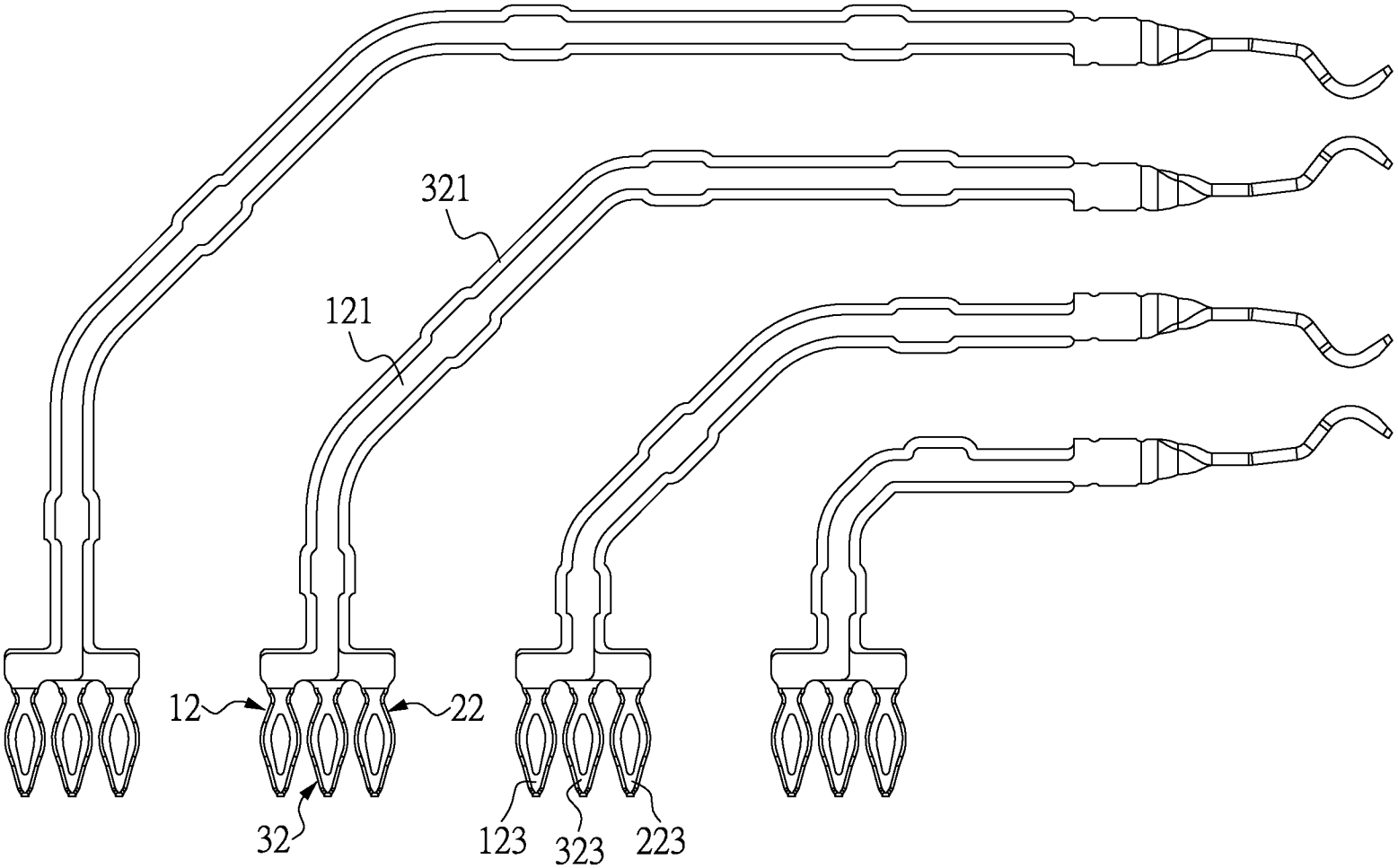
FIG. 9 is a perspective view of the terminals of the transmission module in another type when viewing along the coupling direction according to the instant disclosure.

Thus, about the crosstalk-resistant, the communication connector 100 as shown in FIG. 5 of the instant disclosure is obviously better than the conventional communication connector, and the communication connector 100 as shown in FIG. 5, in which the terminals of FIG. 5 are replaced by the terminals of FIG. 9, is still better than the conventional communication connector.

Moreover, please refer to FIG. 11, which shows a simulation diagram of the impedance of the communication connector 100 of the instant disclosure with respect to the conventional communication connector. The conventional communication connector means the mating portions of the signal terminals thereof are formed in broad coupling type, that is to say, each pair of mating portions of the conventional communication connector is identical to the second or fourth pair of mating portions 122, 222 counted from top to bottom of FIG. 7. The curve A in FIG. 11 presents the simulation curve of the impedance of the conventional communication connector, and the curve B in FIG. 11 presents a simulation curve the impedance of the communication connector 100 as shown in FIG. 5.

According to FIG. 11, the communication connector 100 of the instant disclosure has the impedance more stable than the conventional communication connector by the first and second signal wafers 1, 2 adapting the narrow coupling type.

[The Possible Effects of the Instant Embodiment]

In summary, the communication connector of the instant disclosure, which has the said effects better than the conventional, is provided with different structure in reference to the conventional communication connector. When the width of the main portion of each grounding terminal is less than or equal to two times of the width of the corresponding first or second main portion, the crosstalk-resistant of the communication connector of the instant disclosure is better than the conventional communication connector. Especially, when each first main portion and each second main portion orthogonally projecting to the corresponding main portion along the coupling direction, each one of the contour of each first main portion and the contour of each second main portion aligns the contour of the corresponding main portion, whereby the crosstalk-resistant of the communication connector of the instant disclosure is significantly better than the conventional communication connector.

Moreover, when the first main portion, the corresponding second main portion, and the corresponding main portion have the same constructions, the communication connector not only obtains the better high frequency effect (i.e., the crosstalk-resistant), but also reduces the cost by producing the first signal, second signal, and the grounding terminals with one mold and different die molds, in which the different die molds are used for producing the different parts of the terminals (i.e., first tail, second tail, tail).

Additionally, the communication connector of the instant disclosure does not need any conductive component to connect (e.g., series connect) the grounding terminals of the stacked transmission modules, so that the assembly steps and the structure of the communication connector can be simplified.

Besides, the first coupling segment and the adjacent second coupling segment of the communication connector are formed in narrow coupling type, that is different from the broad coupling type of the conventional communication connector, thereby obtaining the impedance more stable than the conventional communication connector.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A communication connector, comprising:

a plurality of transmission modules stacked in one row along a coupling direction, and each transmission module comprising:

a first signal wafer including a plurality of first signal terminals approximately in coplanar arrangement and a first insulating body, each first signal terminal having a first main portion, a first mating portion, and a first tail, wherein the first mating portion and the first tail are respectively extended from two ends of the first main portion, wherein a side surface of each first main portion has an embedded area and an exposed area, the embedded area of each first main portion is embedded in the first insulating body, the exposed area of each first main portion is exposed from the first insulating body, wherein a width of the exposed area of the side surface of each first main portion is larger than a width of the embedded area of the side surface of each first main portion;

a second signal wafer including a plurality of second signal terminals approximately in coplanar arrangement and a second insulating body, each second signal terminal having a second main portion, a second mating portion, and a second tail, wherein the second mating portion and the second tail are respectively extended from two ends of the second main portion, wherein a side surface of each second main portion has an embedded area and an exposed area, the embedded area of each second main portion is embedded in the second insulating body, the exposed area of each second main portion is exposed from the second insulating body, wherein a width of the exposed area of the side surface of each second main portion is larger than a width of the embedded area of the side surface of each second main portion; and a grounding wafer including a plurality of grounding terminals approximately in coplanar arrangement, each grounding terminal having a main portion, a mating portion, and a tail, wherein the mating portion and the tail are respectively extended from two ends of the main portion;

wherein at each transmission module along the coupling direction, the first signal terminals respectively correspond to the grounding terminals, the second signal terminals respectively correspond to the grounding terminals, each grounding terminal and the corresponding first and second terminals are arranged in one row along the coupling direction, the width of the main portion of each grounding terminal is less than or equal to two times of the width of the first main portion of the corresponding first signal terminal, and when each first main portion orthogonally projecting to the corresponding main portion, the contour of each first main portion is inside the contour of the corresponding main portion; the width of the main portion of each grounding terminal is less than or equal to two times of the width of the second main portion of the corresponding second signal terminal, and when each second main portion orthogonally projecting to the corresponding main portion, the contour of each second main portion is inside the contour of the corresponding main portion; and an outer casing sleeved at the transmission modules, the outer casing having at least one inserting opening, wherein the mating portions, the first mating portions, and the second mating portions are exposed from the inserting opening.

2. The communication connector according to claim 1, wherein at each transmission module along the coupling direction, the first signal terminals respectively correspond to the second signal terminals, and when each first main portion orthogonally projecting to the corresponding second main portion, the contour of each first main portion aligns the contour of the corresponding second main portion.

3. The communication connector according to claim 1, wherein at each transmission module along the coupling direction, the first signal terminals respectively correspond to the second signal terminals, each first signal terminal and the corresponding second signal terminal are defined as a pair of differential signal terminals.

4. The communication connector according to claim 1, wherein at the grounding wafers of the transmission modules, the main portions of the grounding terminals are isolated and independent to each other in structural construction and electrical connection.

5. The communication connector according to claim 1, wherein an outer surface of each first main portion of each first signal terminal, excluding the exposed area of the side surface of each first main portion, is embedded in the corresponding first insulating body; wherein an outer surface of each second main portion of each second signal terminal, excluding the exposed area of the side surface of each second main portion, is embedded in the corresponding second insulating body.

6. The communication connector according to claim 5, wherein each grounding wafer includes an insulating body, and wherein a side surface of each main portion has an embedded area and an exposed area, the embedded area of each main portion is embedded in the insulating body, the exposed area of each main portion is exposed from the insulating body, wherein a width of the exposed area of the side surface of each main portion is larger than a width of the embedded area of the side surface of each main portion.

7. The communication connector according to claim 3, wherein when each first main portion orthogonally projecting to the corresponding second main portion, the contour of each first main portion aligns the contour of the corresponding second main portion, and when each first main portion orthogonally projecting to the main portion of the corresponding grounding terminal, the contour of each first main portion aligns the contour of the main portion of the corresponding grounding terminal.

8. The communication connector according to claim 7, wherein the width of the main portion of each grounding terminal is larger than or equal to 0.24 mm.

9. The communication connector according to claim 7, further to be defined as a mini SAS HD connector.

10. A transmission module of a communication connector, comprising:

a plurality of first signal terminals approximately in coplanar arrangement, each first signal terminal having a first main portion, a first mating portion, and a first tail, wherein the first mating portion and the first tail are respectively extended from two ends of the first main portion;

a first insulating body, wherein a side surface of each first main portion has an embedded area and an exposed area, the embedded area of each first main portion is embedded in the first insulating body, the exposed area of each first main portion is exposed from the first insulating body, wherein a width of the exposed area of the side surface of each first main portion is larger than a width of the embedded area of the side surface of each first main portion;

a plurality of second signal terminals approximately in coplanar arrangement, each second signal terminal having a second main portion, a second mating portion, and a second tail, wherein the second mating portion and the second tail are respectively extended from two ends of the second main portion;

a second insulating body, wherein a side surface of each second main portion has an embedded area and an exposed area, the embedded area of each second main portion is embedded in the second insulating body, the exposed area of each second main portion is exposed from the second insulating body, wherein a width of the exposed area of the side surface of each second main portion is larger than a width of the embedded area of the side surface of each second main portion; and a plurality of grounding terminals approximately in coplanar arrangement, each grounding terminal having a main portion, a mating portion, and a tail, wherein the mating portion and the tail are respectively extended from two ends of the main portion;

wherein the first signal terminals, the second signal terminals, and the grounding terminals are respectively arranged at three parallel planes, and the planes are perpendicular to a coupling direction, wherein at the transmission module along the coupling direction, the first signal terminals respectively correspond to the grounding terminals, the second signal terminals respectively correspond to the grounding terminals, each grounding terminal and the corresponding first and second terminals are arranged in one row along the coupling direction, the width of the main portion of each grounding terminal is less than or equal to two times of the width of the first main portion of the corresponding first signal terminal, and when each first main portion orthogonally projecting to the corresponding main portion, the contour of each first main portion is inside the contour of the corresponding main portion; the width of the main portion of each grounding terminal is less than or equal to two times of the width of the second main portion of the corresponding second signal terminal, and when each second main portion orthogonally projecting to the corresponding main portion, the contour of each second main portion is inside the contour of the corresponding main portion.

11. The transmission module according to claim 10, wherein along the coupling direction, the first signal terminals respectively correspond to the second signal terminals, and when each first main portion orthogonally projecting to the corresponding second main portion, the contour of each first main portion aligns the contour of the corresponding second main portion.

12. The transmission module according to claim 10, wherein along the coupling direction, the first signal terminals respectively correspond to the second signal terminals, each first signal terminal and the corresponding second signal terminal are defined as a pair of differential signal terminals.

13. The transmission module according to claim 10, wherein the main portions of the grounding terminals are isolated and independent to each other in structural construction and electrical connection.

14. The transmission module according to claim 10, wherein an outer surface of the first main portion of each first signal terminal, excluding the exposed area of the side surface of each first main portion, is embedded in the corresponding first insulating body, an outer surface of the second main portion of each second signal terminal, excluding the exposed area of the side surface of each second main portion, is embedded in the corresponding second insulating body.

15. The transmission module according to claim 12, wherein when each first main portion orthogonally projecting to the corresponding second main portion, the contour of each first main portion aligns the contour of the corresponding second main portion, and when each first main portion orthogonally projecting to the main portion of the corresponding grounding terminal, the contour of each first main portion aligns the contour of the main portion of the corresponding grounding terminal.

16. The transmission module according to claim 15, wherein the width of the main portion of each grounding terminal is larger than or equal to 0.24 mm.

17. The transmission module according to claim 10, wherein along the coupling direction, the first signal terminals respectively correspond to the second signal terminals, wherein each one of the first and second mating portions has two opposite side surfaces and a surrounding surface arranged between the side surfaces, the width of each side surface is larger than the width of each surrounding surface, wherein the surrounding surface of the first mating portion of at least one of the first signal terminals is at least partially adjacent and facing to the surrounding surface of the second mating portion of the corresponding second signal terminal.

18. The transmission module according to claim 17, wherein the first mating portion of each first signal terminal has a first extending segment, a first twisted segment, and a first coupling segment, which are extended from the first main portion sequentially, wherein the side surfaces of each first coupling segment are non-parallel to the side surfaces of each first extending segment; the second mating portion of each second signal terminal has a second extending segment, a second twisted segment, and a second coupling segment, which are extended from the second main portion sequentially, wherein the side surfaces of each second coupling segment are non-parallel to the side surfaces of each second extending segment; wherein the surrounding surface of the first coupling segment of at least one of the first signal terminals is at least partially adjacent and facing to the surrounding surface of the second coupling segment of the corresponding second signal terminal.

19. The transmission module according to claim 17, wherein the surrounding surface of the first mating portion of each first signal terminal is at least partially adjacent and facing to the surrounding surface of the second mating portion of the corresponding second signal terminal; the first mating portion of each first signal terminal has a first extending segment, a first twisted segment, and a first coupling segment, which are extended from the first main portion sequentially, wherein the side surfaces of each first coupling segment are non-parallel to the side surfaces of each first extending segment; the second mating portion of each second signal terminal has a second extending segment, a second twisted segment, and a second coupling segment, which are extended from the second main portion sequentially, wherein the side surfaces of each second coupling segment are non-parallel to the side surfaces of each second extending segment; wherein along the coupling direction, a portion of the surrounding surface of the first coupling segment of each first signal terminal is adjacent to a portion of the surrounding surface of the second coupling segment of the corresponding second signal terminal; wherein any two adjacent first twisted segments respectively have two opposite twist directions, and any two adjacent second twisted segments respectively have two opposite twist directions.

20. The transmission module according to claim 19, wherein the first twisted segment of each first signal terminal is twisted from the first extending segment toward the first coupling segment with approximate ninety degrees, the second twisted segment of each second signal terminal is twisted from the second extending segment toward the second coupling segment with approximate ninety degrees, wherein the width of each side surface of the first twisted segment of each first signal terminal gradually reduces along a direction defined from the first extending segment toward the first coupling segment, the width of each side surface of the second twisted segment of each second signal terminal gradually reduces along a direction defined from the second extending segment toward the second coupling segment; wherein a portion of the surrounding surface of the first coupling segment of each first signal terminal is adjacent to a portion of the surrounding surface of the second coupling segment of the corresponding second signal terminal, and the adjacent portions of the surrounding surfaces of the first and second coupling segments are facing and parallel to each other.

* * * * *